US006169863B1

(12) United States Patent
Osari et al.

(10) Patent No.: US 6,169,863 B1
(45) Date of Patent: Jan. 2, 2001

(54) IMAGE FORMATION APPARATUS CAPABLE OF RECEIVING PLURAL JOBS

(75) Inventors: Yoshihito Osari; Masahiro Serizawa, both of Shizuoka-ken (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/425,005

(22) Filed: Oct. 25, 1999

(30) Foreign Application Priority Data

Oct. 27, 1998 (JP) ..... 10-305286
Nov. 4, 1998 (JP) ..... 10-313237

(51) Int. Cl.[7] ..... G03G 15/00
(52) U.S. Cl. ..... 399/82; 399/85; 399/391
(58) Field of Search ..... 399/23, 81, 82, 399/83, 85, 86, 87, 391, 392, 393; 271/9.01, 9.02, 9.09

(56) References Cited

U.S. PATENT DOCUMENTS 4,008,957 * 2/1977 Summers ..... 399/82
4,350,434 * 9/1982 Paulus et al. ..... 399/82
5,459,580 * 10/1995 Suzuki ..... 399/85
5,689,765 * 11/1997 Nishinozono ..... 399/81

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

In a structure that setting for a second job is possible even if a first job is being executed, if the first job is the job which uses a manual sheet feed unit, a sheet selection key is handled on a second job setting screen to display a manual feed key with shading or halftone dots on a sheet setting screen. Thus, it is inhibited from selecting the manual sheet feed unit, whereby it is inhibited from changing sheet size setting of the manual sheet feed unit.

34 Claims, 14 Drawing Sheets

170
IMAGE PROC UNIT
109
CCD
501
A/D & SH UNIT
502
LOG CONVERSION UNIT
503
MAGNIFI-CATION CHANGE UNIT
504
GAMMA CORRECTION UNIT
505
BINARIZATION UNIT
4
EXTERNAL I/F PROC UNIT
3
IMAGE MEMORY UNIT
2
PRINTER UNIT
506
SMOOTHING UNIT
120
EXPOSURE CONTROL UNIT

IMAGE FORMATION APPARATUS CAPABLE OF RECEIVING PLURAL JOBS

BACKGROUND OF THE INVENTION

1. Field of the Invention

The present invention relates to setting of recording sheet (or paper) which is used in an image formation apparatus capable of receiving plural copy jobs or plural print jobs.

2. Related Background Art

By the recent development of network technique, a countermeasure for network has been also developed in a printer and even in a copying machine having a printer function. Thus, some kinds of printers and copying machines can process plural print jobs instructed from plural clients on the network.

If such the printer or the copying machine has an image storage unit (i.e., image server) such as a hard disk or the like, it can simultaneously receive the plural print jobs and then sequentially process the received jobs. In these printers and copying machines, some printers and copying machines each of which has plural operation screens respectively corresponding to the plural types of print jobs and can set a print mode on one operation screen even during the operation in the other print job have been proposed.

Further, some conventional printers and copying machines respectively have sheet feed stages (or trays) called manual feed trays each of which can feed an unfixed-size sheet and performs sheet size setting from the operation screen according as the such the unfixed-size sheet is set. Further, some manual feed trays can feed plural kinds of materials such as an ordinary sheet, an OHP (overhead projector) sheet, a thick sheet, a thin sheet and the like as well as the unfixed size sheet, and can set the data representing that one of these materials is set on the manual feed tray and thus being used for carrying control and process control suitable for that material.

On the other hand, some copying machines and printers are provided with an OHP insertion mode. In the OHP insertion mode, the OHP sheet fed from the manual feed tray and the ordinary sheet (on which the image same as that formed on the OHP sheet has been formed) fed from the other sheet feed stage are alternately output.

As above, if the copying machine or the printer which has the manual feed tray further has the image storage unit, it can simultaneously receive the plural jobs and has the setting screens respectively corresponding to these jobs. However, in such the case, following problems occur.

That is, for example, in the conventional copying machine or the printer which can not simultaneously receive the plural jobs, the once-set sheet size on the manual feed tray is never changed until the job ends. However, if the setting for plural jobs can be performed on the respective setting screens, the sheet size on the manual feed tray set on one setting screen can be easily changed on the other setting screen even if the corresponding job is being executed. Thus, since the sheet of which size is different from that of the previously output sheet is output on the way of an output sheaf of sheets in the executing job, the sizes of the output sheets can not be unified.

Further, in case of performing the setting for OHP insertion mode, it is thought that such a mode as to feed a sheet other than the OHP sheet from the manual feed tray in another job is being executed. In this case, it is impossible to freely set the OHP insertion mode.

SUMMARY OF THE INVENTION

An object of the present invention is to provide an image formation apparatus which solved the above-described problems and a control method of this apparatus.

Another object of the present invention is to provide an image formation apparatus which can obviate such sheet setting as to influence other jobs and a control method of this apparatus.

Still another object of the present invention is to provide an image formation apparatus which can obviate a disadvantage that a sheet size or a kind of sheet is unnecessarily changed on the way of a job, and a control method of this apparatus.

Other objects and features of the present invention will become apparent from the following detailed description and the attached drawings.

DETAILED DESCRIPTION OF THE PREFERRED EMBODIMENT

Hereinafter, the embodiment of the present invention will be explained with reference to the accompanied drawings.

Figure 1:
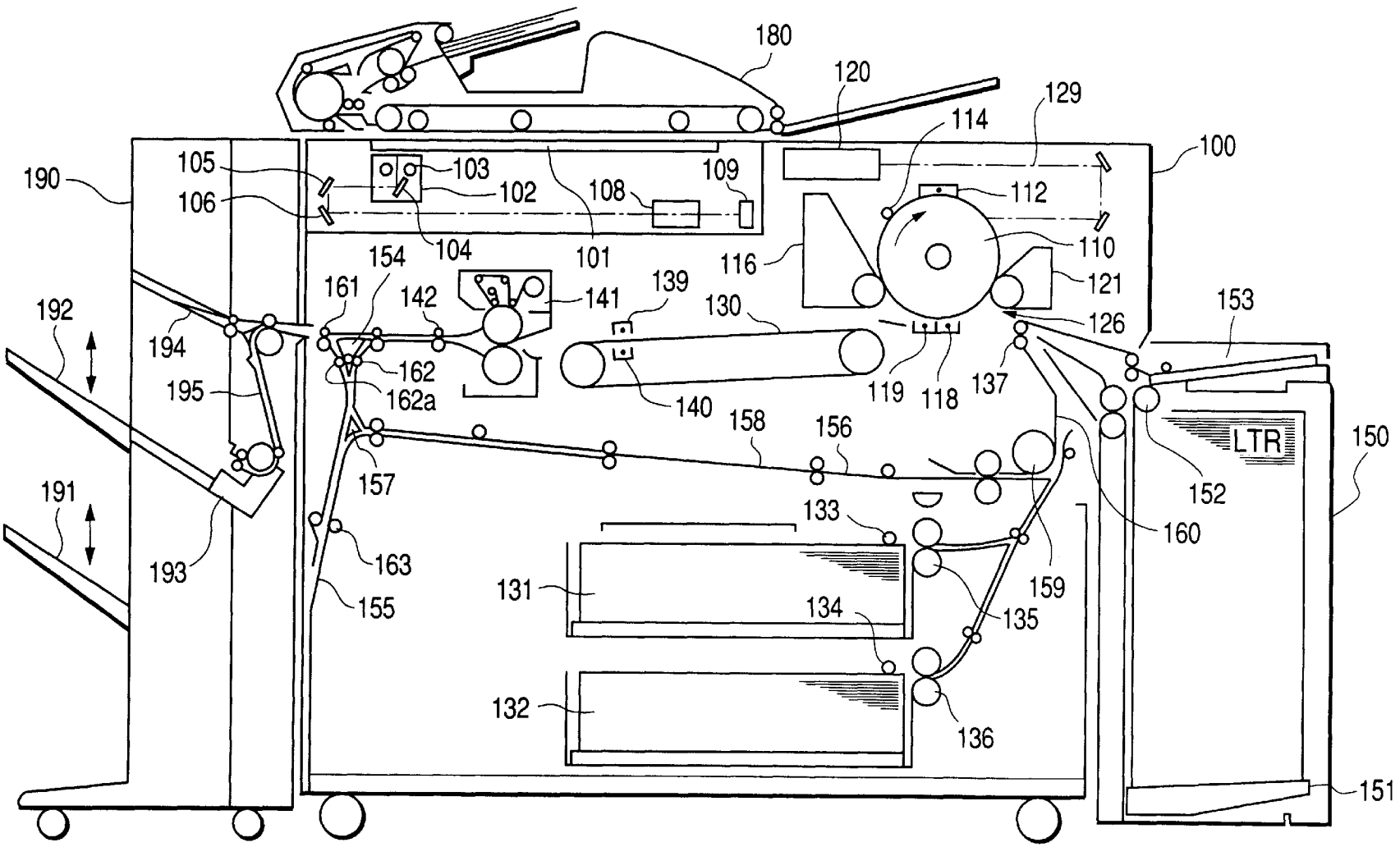
FIG. 1 is a sectional view showing an image formation apparatus to which the present invention is applicable.

FIG. 1 is a sectional view showing an example of an image formation apparatus to which the present invention is applicable. In FIG. 1, numeral 100 denotes the image formation apparatus (or a main body thereof), and numeral 180 denotes an automatic document feed device (ADF). Numeral 101 denotes a platen glass which acts as an original stacking board. Numeral 102 denotes a scanner which is composed of an original illumination lamp 103, a scanning mirror 104 and the like. The scanner 102 is reciprocated by a not-shown motor in a predetermined direction to scan an original on the platen glass 101. Reflection light from the original is guided into a CCD (charge-coupled device) sensor 109 through scanning mirrors 104 to 106 and a lens 108. Numeral 120 denotes an exposure control unit which is composed of a laser, a polygonal scanner and the like. The unit 120 irradiates a laser beam 129 onto a photosensitive drum 110. In this case, the laser beam 129 has been modulated on the basis of an image signal converted and subjected to a predetermined image process by the image sensor unit 109. A primary charger 112, a development unit 121, a transfer charger 118, a cleaning unit 116 and a preexposure lamp 114 are disposed around the photosensitive drum 110. In an image formation unit 126, the photosensitive drum 110 is driven by a not-shown motor in the direction indicated by the arrow shown in the drawing. After the photosensitive drum 110 is charged by the primary charger 112 up to desired potential, the drum 110 is irradiated by the laser beam 129 from the exposure control unit 120, whereby an electrostatic latent image is formed on the drum 110. Then the electrostatic latent image is developed by the development unit 121 and thus visualized as a toner image.

A transfer sheet which is supplied from an upper cassette 131 or a lower cassette 132 by a pickup roller 133 or 134 is carried by a sheet feed roller 135 or 136. After then, the sheet is fed to a transfer belt 130 by a registration roller 137, and the visualized toner image is transferred onto the sheet by the transfer charger 118. After the toner image is transferred onto the sheet, residual toner on the photosensitive drum 110 is cleaned off by the cleaning unit 116, and also residual charges are erased by the preexposure lamp 114. Then the transfer sheet is separated from the transfer belt 130, and the toner image is again charged by prefixing chargers 139 and 140. The transfer sheet is then carried to a fixing unit 141, and the toner on the transfer sheet is pressed and heated to be fixed to the sheet. Then the transfer sheet is discharged outside the main body 100 by a sheet discharge roller 142.

In the main body 100, a deck 150 capable of holding, e.g., 4000 transfer sheets is installed. A lifter 151 of the deck 150 is lifted according to a quantity of the transfer sheets such that the sheets are always in contact with a sheet feed roller 152. Further, a manual feed tray 153 capable of holding 100 arbitrary-size sheets is installed. Further, in FIG. 1, numeral 154 denotes a sheet discharge flapper which changes a path between a two-face recording or multirecording side and a sheet discharge side. The transfer sheet from the sheet discharge roller 142 is carried to either the two-face recording side or the multirecording side by the flapper 154. Numeral 158 denotes a lower carrying path which reverses or turns the transfer sheet from the roller 142 through an inversion path 155 and then guides the reversed sheet to a sheet refeed tray 156. Numeral 157 denotes a multiflapper which changes the path between the two-face recording side and the multirecording side. By turning over the multiflapper 157 leftward, the transfer sheet is directly guided to the lower carrying path 158 without passing the inversion path 155. Numeral 159 denotes a sheet feed roller which feeds the transfer sheet to the side of the photosensitive drum 126 through the path 160. Numeral 161 denotes a discharge roller 142 which is disposed in the vicinity of the sheet discharge flapper 154 and thus discharges outward the transfer sheet guided to the discharge side by the flapper 154. In the two-face recording (i.e., two-face copying) and the multirecording (i.e., multicopying), the sheet discharge flapper 154 is lifted off to guide the copy-ended transfer sheet to the sheet refeed tray 156 through the carrying paths 155 and 158. At this time, the multiflapper 157 is turned over rightward in the two-face recording, while the multiflapper 157 is turned over leftward in the multirecording. The transfer sheets put on the sheet refeed tray 156 are fed one by one from the bottom by the sheet feed roller 159 to the registration roller 137 of the main body through a path 160. When the sheet is inverted and then discharged outward the main body, the sheet discharge flapper 154 is lifted off and the multiflapper 157 is turned over rightward to carrying the copy-ended transfer sheet to the side of the carrying path 155. Then, after the trailing edge of the transfer sheet passes a first feed roller 162, the sheet is carried to the side of a second feed roller 162a by an inversion roller 163. Thus, the sheet is inverted and discharged outward by the discharge roller 161.

Numeral 190 denotes a sheet discharge process apparatus (i.e., finisher) which arranges and binds the transfer sheets discharged from the main body 100 of the image formation apparatus. If a postprocess of a sheaf of sheets including sorting, stapling and the like is not set on a later-described operation unit 172 (FIG. 2), the sheets are discharged one by one onto a sheet discharge tray 191 through a carrying path 194 without a process tray 193. Conversely, if the postprocess is set, the transfer sheets discharged one by one through a carrying path 195 are stacked and arranged on the process tray 193. After discharging of the image-formed transfer sheets of one group ends, the sheaf of discharged sheets is stapled and discharged onto the sheet discharge tray 191 or 192. If the postprocess of the sheaf of sheets is set, the sheaf is basically discharged onto the sheet discharge tray 192. However, e.g., if the tray 192 is full of the sheets, it is controlled to discharge the sheaf onto the tray 191 instead. The sheet discharge tray 191 or 192 is moved upward and downward by a not-shown motor such that the tray reaches the position of the process tray before the image process operation starts.

Figure 2:
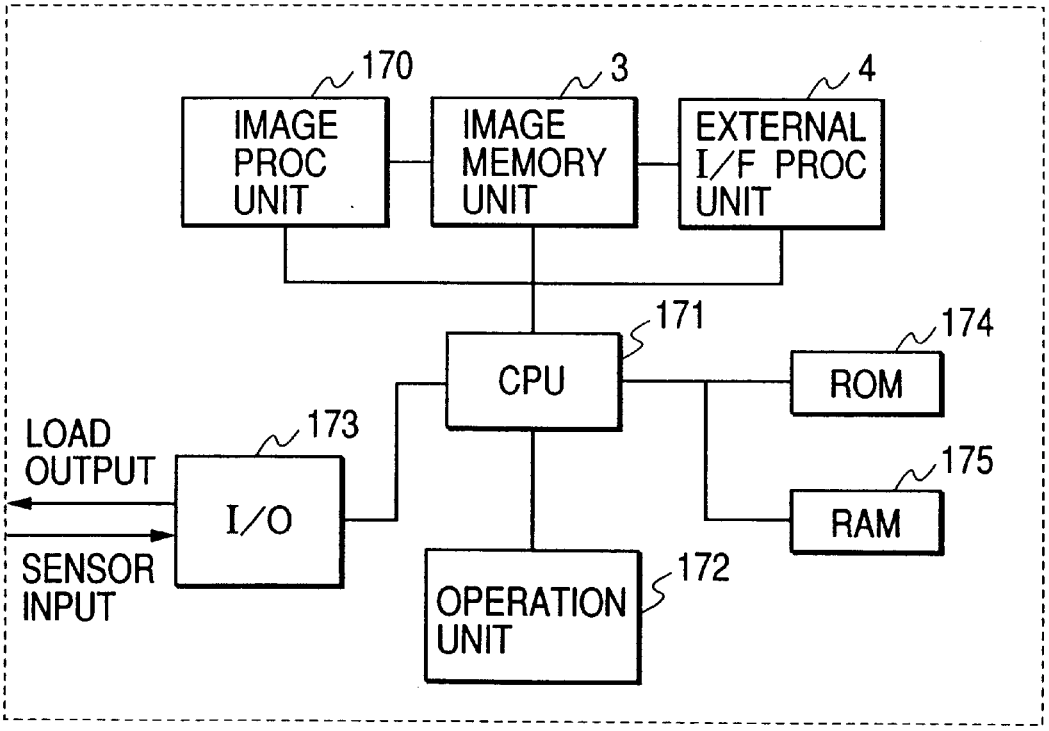
FIG. 2 is a control block diagram showing a structure of a reader unit of the image formation apparatus.

FIG. 2 is a control block diagram of the image formation apparatus 100. Numeral 171 denotes a CPU (central processing unit) which performs basic control of the apparatus 100. The CPU 171 is connected with a ROM (read-only memory) 174 in which a control program has been written, a working RAM (random access memory) 175 which is used to perform various processes, and an I/O (input and output) port 173 through address and data buses. The I/O port 173 is connected with various loads (not shown) such as a motor, a clutch and the like of the apparatus 100, and a sensor (not shown) which detects a position of sheet.

The CPU 171 sequentially performs input/output control through the I/O port 173 in accordance with the contents of the ROM 174, thereby performing the image formation operation. Further, the CPU 171 is connected with the operation unit 172, whereby the CPU 171 controls displays and input keys of the unit 172. A user handles an input key to instruct the CPU 171 to change image formation operation modes and displayed contents, whereby the CPU 171 displays the state of the apparatus 100 and the operation mode setting by key input. The CPU 171 is connected with an image process unit 170 which processes an image converted in the form of an electrical signal an electrical signal converted by the image sensor unit 109 and an image memory unit 3 which stores processed images.

Figure 3:
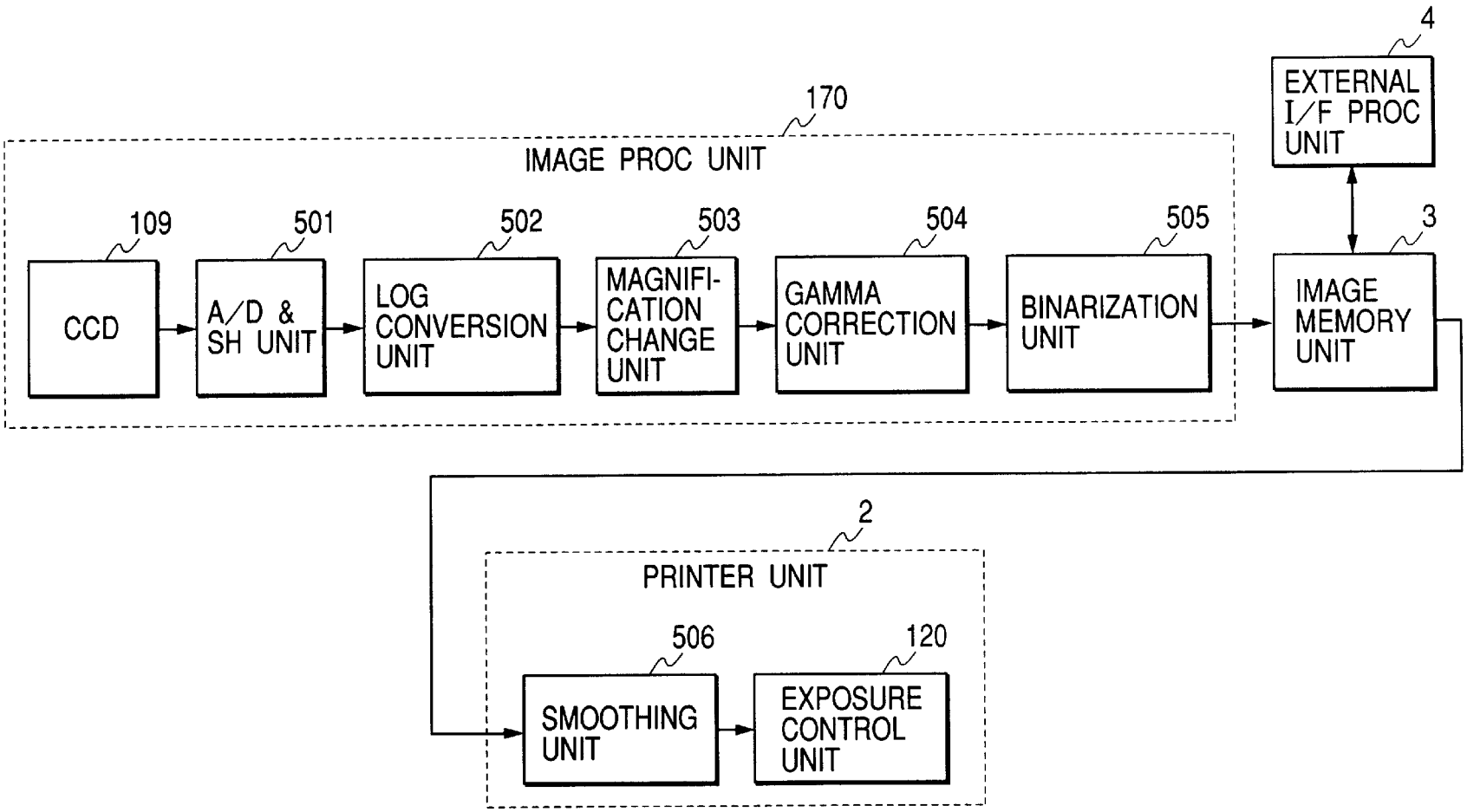
FIG. 3 is a block diagram showing structures of an image process unit and a printer unit.

Next, the details of the image process unit 170 will be explained with reference to FIG. 3. FIG. 3 is a block diagram showing the image process unit 170. The original which was imaged on the CCD sensor 109 through the lens 108 is input as luminance data of an black image and then converted into an analog electrical signal by the sensor 109. Such converted image information is input to an analog signal process unit (not shown), and subjected to a sampling-and-holding process and dark-level correction. Then, by an A/D & SH unit 501, the signal is subjected to analog-to-digital (A/D) conversion, and the converted digital signal is subjected to shading correction. The shading correction is performed to correct dispersion of the sensors for reading the original and a light distribution characteristic of the original illumination lamp. Then the luminance data is input to a logarithmic conversion unit 502 which includes a lookup table (LUT). The LUT converts the input luminance data into density data, by outputting the table value corresponding to the input data. Then the image is subjected to magnification change (or zooming) by a magnification change unit 503, and the data is input to a gamma correction unit 504. When the gamma correction unit 504 outputs the density data, it performs conversion with the LUT in consideration of the printer characteristic, in order to adjust the output according to the density value set on the control unit. Then the density data is input to a binarization unit 505, whereby the multi-value density data is binarized to output the density value "0" or "255". The eight-bit image data is binarized and then converted into the one-bit image data of "0" or "1". Thus, a quantity of the image data to be stored in the memory decreases.

However, if the image is binarized, the number of gradations of the image changes from "256" to "2". For this reason, if such image data as representing a photographic image including many halftone portions is binarized, quality of such the image is seriously deteriorated. In order to prevent this, pseudo halftone representation by the binary data is necessary. In the present embodiment, an error diffusion method is used as the method to perform the pseudo halftone representation based on the binary data. In this method, if the density of one image is larger than one threshold value, density data of "255" is given and binarized. Conversely, if the density is equal to or smaller than that value, density data of "0" is given and binarized. Then a difference between the actual density data and the binarized data is given as a difference signal, and the difference signal is diffused to peripheral pixels. Concretely, a weight coefficient in a matrix prepared beforehand is multiplied by the error caused in the binarization, and the obtained value is added to the peripheral pixels, thereby performing the error diffusion. Thus, an average value of the density is preserved for the entire image, whereby it is possible to perform pseudo binary representation of halftone.

The binarized image data is transferred to the image memory unit 3, and subjected to image accumulation. Since image data input from an external computer through an external interface (I/F) process unit 4 has been already processed as binary image data in the unit 4, the input image data is transferred to the image memory unit 3 as it is. The image memory unit 3 includes a high-speed page memory and a large-capacity memory (i.e., hard disk (HD)) capable of storing image data of plural pages. The plural image data stored in the HD are output in the order according to an editing mode instructed on the operation unit of the image formation apparatus 100. For example, in the sorting, the images of the sheaf of originals read by the ADF 180 are output in due order. Namely, the once-stored image data of the original is read from the HD, and this reading is repeated several times to output the images. Thus, the finisher can act as a sorter having plural bins.

The image data output from the image memory unit 3 is transferred to a smoothing unit 506 in a printer unit 2. In the smoothing unit 506, the data is subjected to interpolation to smooth down the edge portions of the binarized image, and then the interpolated image data is input to the exposure control unit 120. In the exposure control unit 120, the image data is formed on the transfer sheet by the above-described process.

Figure 4:
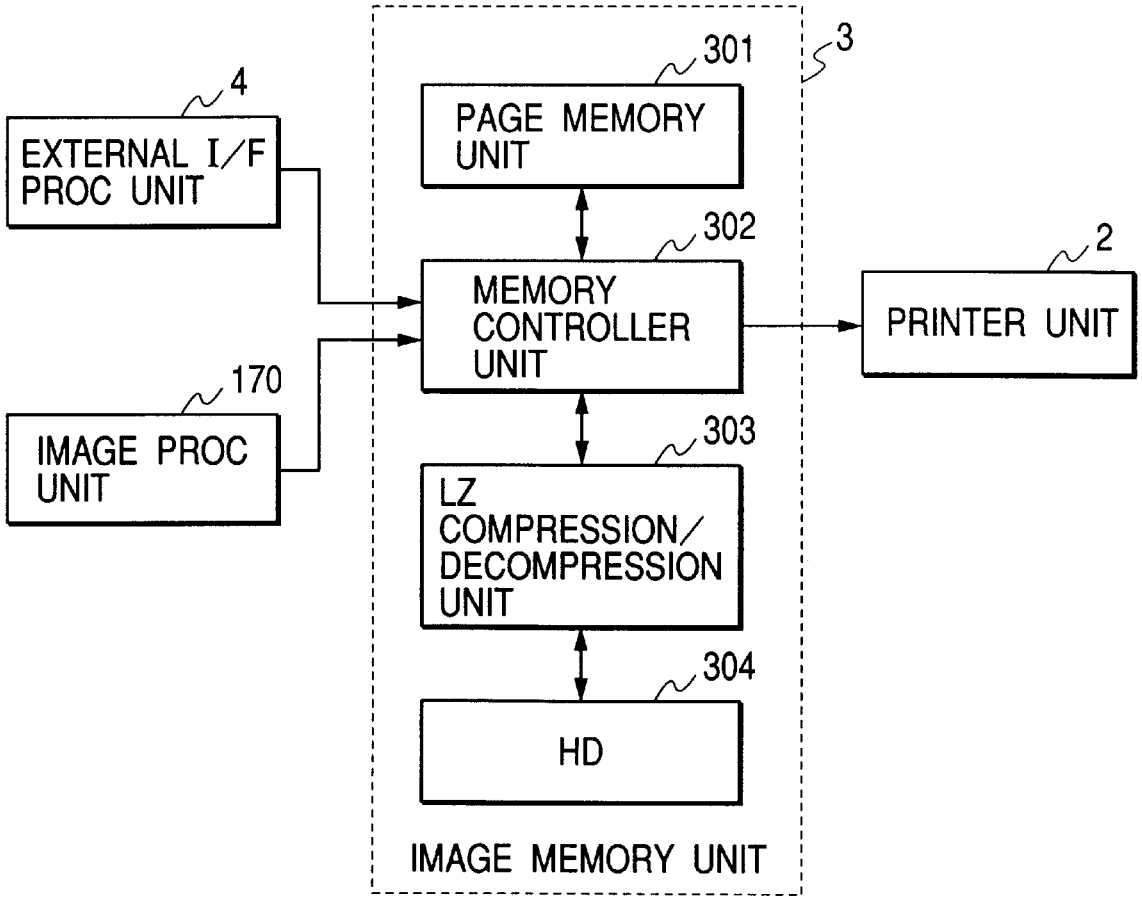
FIG. 4 is a block diagram showing a structure of an image memory unit.

Next, the details of the image memory unit 3 will be described with reference to FIG. 4. In the image memory unit 3, through a memory controller unit 302, the binary images supplied from the external I/F process unit 4 and the image process unit 170 are written into a page memory unit 301 containing a memory such as a DRAM (dynamic random access memory) or the like, the image is output to the printer unit 2, and input/output access of the image to/from a hard disk (HD) 304 being a large-capacity storage unit is performed. An LZ (Lempel-Ziv) compression unit 303 compresses and decompresses the image data in accordance with input/output of the HD 304. The memory controller unit 302 generates a DRAM refreshing signal for the page memory unit 301, and also controls accessing from the external I/F process unit 4, the image process unit 170 and the HD 304 to the page memory unit 301. Further, the memory controller unit 302 controls a writing address to the page memory unit 301, a reading address from the unit 301, a reading direction and the like in accordance with an instruction of the CPU 171. Thus, the CPU 171 controls a function to arrange the plural original images in the page memory unit 301, perform layout of the arranged images and output the layout image to the printer unit, a function to cut off and output only a part of the image, and a function to rotate the image.

Figure 5:
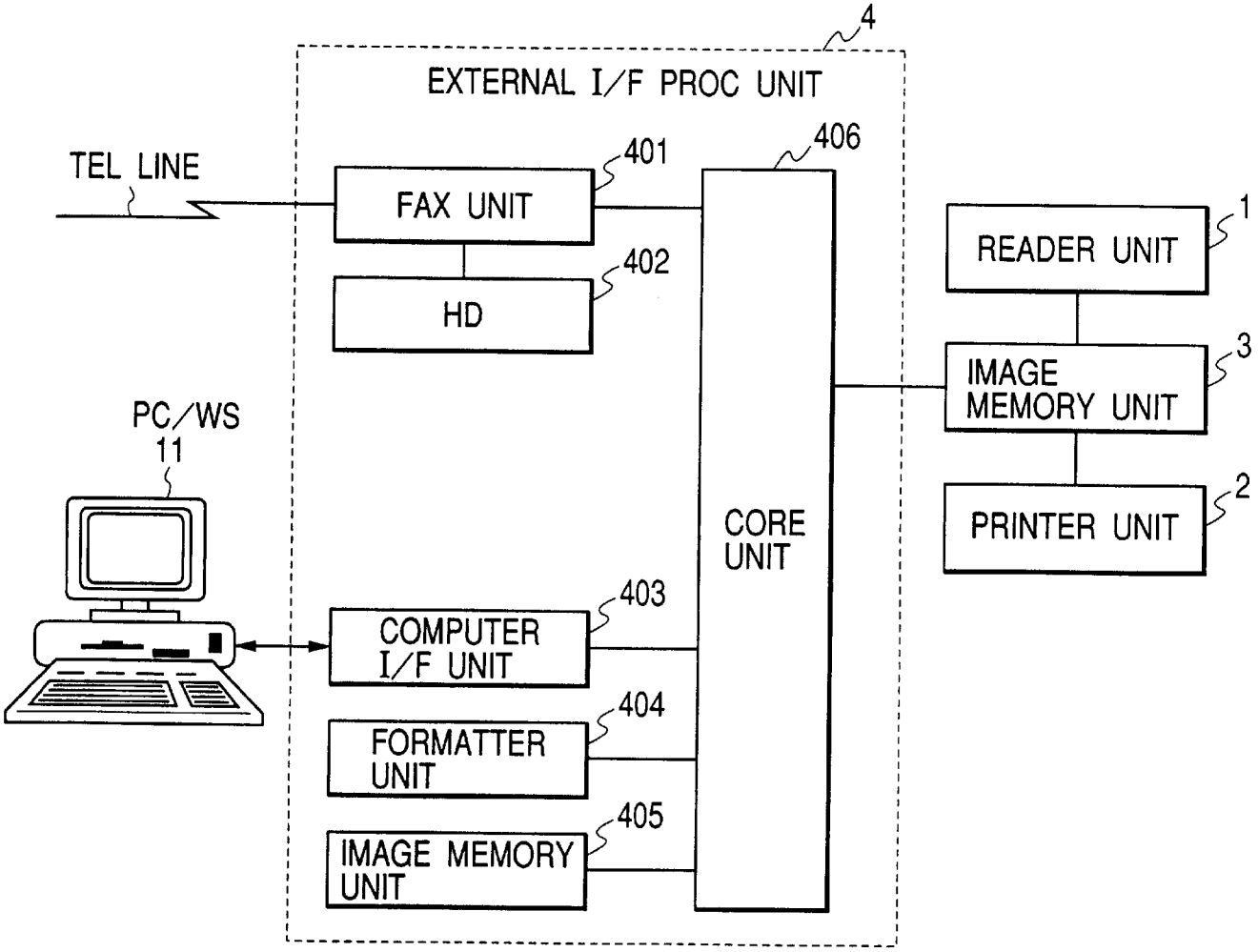
FIG. 5 is a block diagram showing an entire system structure.

Next, a structure of the external I/F process unit 4 will be described with reference to FIG. 5. As described above, the external I/F process unit 4 captures the binary image data from the reader unit 1 through the image memory unit 3, and outputs the binary image data to the printer unit 2 through the image memory unit 3, thereby performing image formation. The external I/F process unit 4 contains a core unit 406, a facsimile unit 401, a hard disk (HD) 402 which stores communication image data of the facsimile unit 401, a computer I/F unit 403 which connects with an external computer 11, a formatter unit 404 and an image memory unit 405. The facsimile unit 401 which is connected to a public line through a modem (not shown) receives facsimile communication data from the public line and transmits facsimile communication data to the public line. The facsimile unit 501 stores facsimile images into the HD 402 for various processes. For example, the facsimile unit 401 performs facsimile transmission at a designated time by reading the stored image from the HD 402, or reads the stored image data from the HD 402 and transmits it in response to a communication partner's inquiry with a designated password. Thus, after the image is once transferred from the reader unit 1 to the facsimile unit 401 and the HD 402 through the image memory unit 3, such the image can be subjected to the facsimile transmission without using the reader unit 1 and the image memory unit 3 as facsimile functions.

The computer I/F unit 403 which performs data communication to the external computer contains a LAN (local area network), a serial interface, an SCSI (small computer system interface), a Centronics interface for printer data input, and the like. States of the printer unit and the reader unit are notified to the external computer through the I/F unit 403. Further, the image read by the reader unit 11 is transferred to the external computer according to an instruction from the computer, through the I/F unit 403. Further, the computer I/F unit 403 receives printing data from the external computer. Since the printing data sent from the external computer through the computer I/F unit 403 has been described by dedicated printer codes, the formatter unit 404 converts these codes into raster image data to perform the image formation by the printer unit 12 through the image memory unit 3.

The formatter unit 404 expands the raster image data to the image memory unit 405. As above, the unit 405 is used as the memory when the formatter unit 404 expands the raster image data. Further, the image memory unit 405 is used when the image from the reader unit 1 is sent to the external computer through the computer I/F unit 403 (i.e., when image scanner function is executed). Namely, the image data sent from the image memory unit 3 is once expanded in the image memory unit 405, the expanded data is converted into the data of which form is suitable to be transferred to the external computer, and the converted data is then transferred to the external computer from the computer I/F unit 403.

The core unit 406 controls and manages data transfer among the facsimile unit 401, the computer I/F unit 403, the formatter unit 404, the image memory unit 405, and the image memory unit 3. Thus, even if the external I/F process unit 4 has plural image output units and one image transfer path to the image memory unit 3, exclusive control and priority control are performed under the control of the core unit 406 to adequately output the images.

Next, the operation unit of the image formation apparatus for setting a copying operation mode will be described with reference to FIG. 6.

Figure 6:
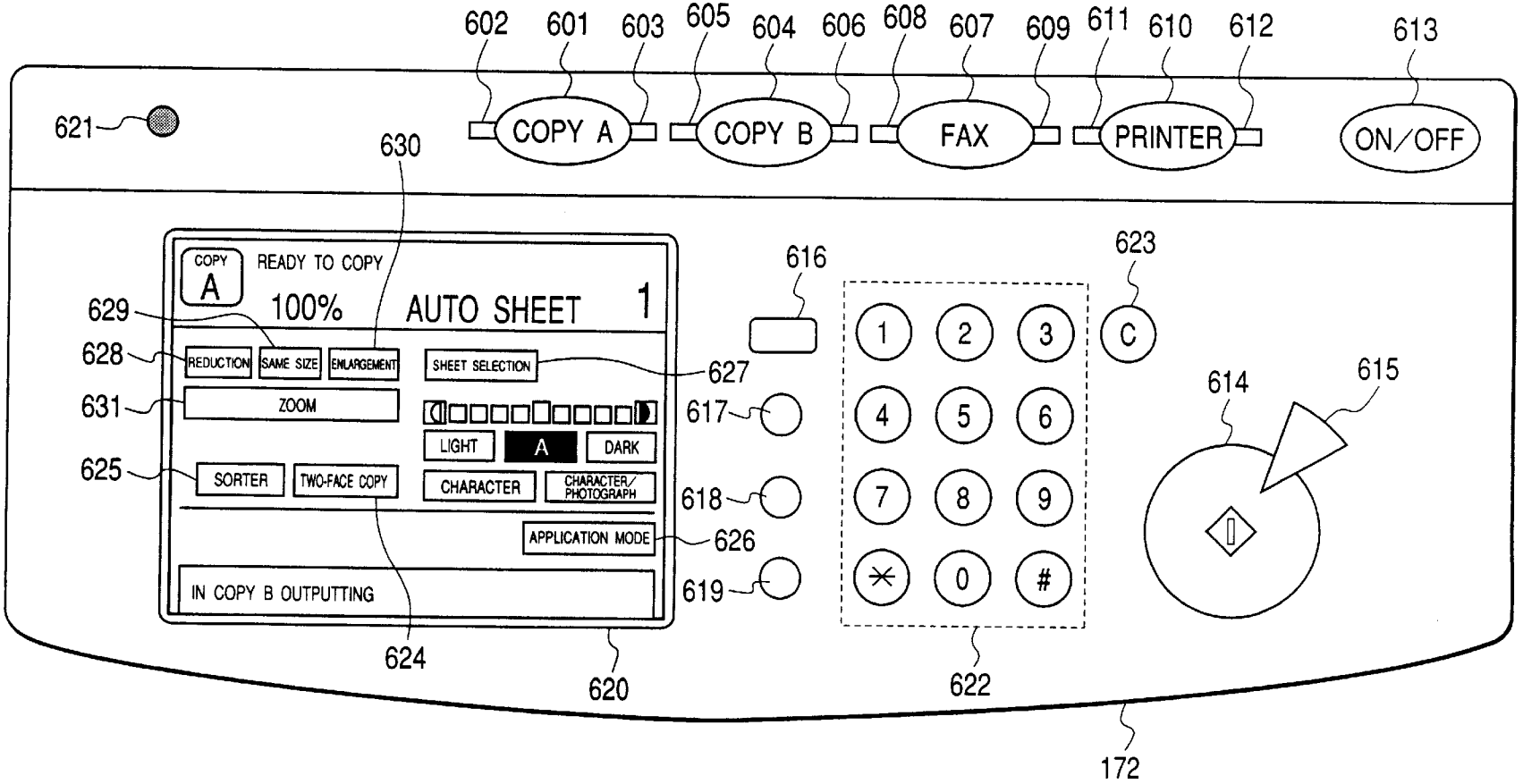
FIG. 6 is a view showing an operation unit of the image formation apparatus.

In FIG. 6, numeral 621 denotes a power lamp which indicates a power-on state. According to power on and off operations by a power key 613, the lamp 621 is turned on and off. Numeral 622 denotes a ten-key unit which is used to set the number of copies (i.e., image formation) and to input numerical values for the mode setting. On a facsimile setting screen, the ten-key unit 622 is used to input telephone numbers. Numeral 623 denotes a clear key which is used to clear the setting input by the ten-key unit 622. Numeral 616 denotes a reset key which is used to reset the set number of copies, the set operation mode, the selected sheet feeder and the like to default values respectively. Numeral 614 denotes a start key. When the start key 214 is depressed, the image formation operation starts. Not-shown red and green LED's (light emitting diode) which indicate whether or not the operation can start are provided at the center of the start key 614. Thus, when the operation can not start, the red LED lights. Conversely, when the operation can start, the greed LED lights. Numeral 615 denotes a stop key which is used to stop the copying operation. Numeral 617 denotes a guide key. If the guide key 617 is depressed and then another key is depressed, the explanation of the function capable of being set by such another key is displayed on a display panel. If the guide key 617 is again depressed, such the guide display is released. Numeral 618 denotes a user setting key. If the user setting key 618 is depressed, the user can change the setting of the image formation apparatus to his desired state. For example, the user can change the time until the setting of image formation mode is automatically cleared, default values of the mode at the time when the reset key is depressed, and the like. Numeral 619 denotes an interruption key. When the key 619 is depressed during the image formation operation, the operation is stopped, and it is possible to perform another copying operation without using the ADF 180. Numeral 620 denotes a display panel which includes a liquid crystal display and the like. The panel 620 changes its display according to the set mode, so as to ease detailed mode setting. A touch sensor is disposed on the surface of the panel 620. FIG. 6 shows an example of the copying operation mode setting screen. In FIG. 6, keys 624 to 631 are displayed on the panel 620. If the user touches the key-displayed position on the panel 620, it is considered that the corresponding key is depressed, thereby setting the corresponding mode. Numeral 627 denotes the sheet feed stage selection key (referred as sheet selection key hereinafter). If the sheet selection key 627 is depressed, the display panel 620 displays the setting as to which of the cassettes 131 and 132, the deck 150 and the manual feed tray 153 the sheet is fed from.

Figure 7A:
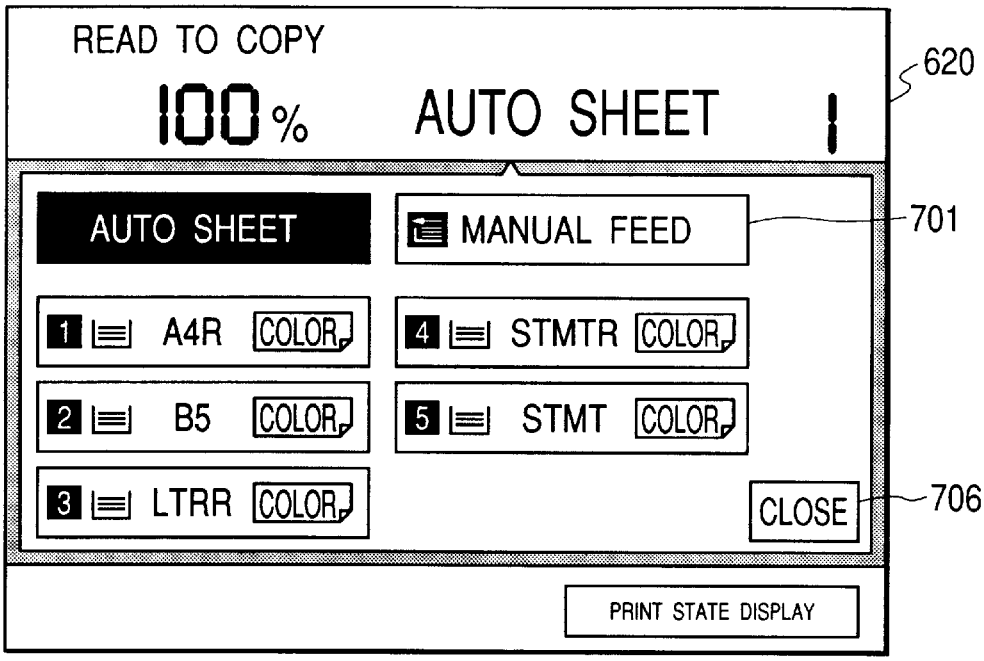
FIGS. 7A, 7B, 7C and 7D are views respectively showing manual sheet feed setting screens of the image formation apparatus.
Figure 7B:
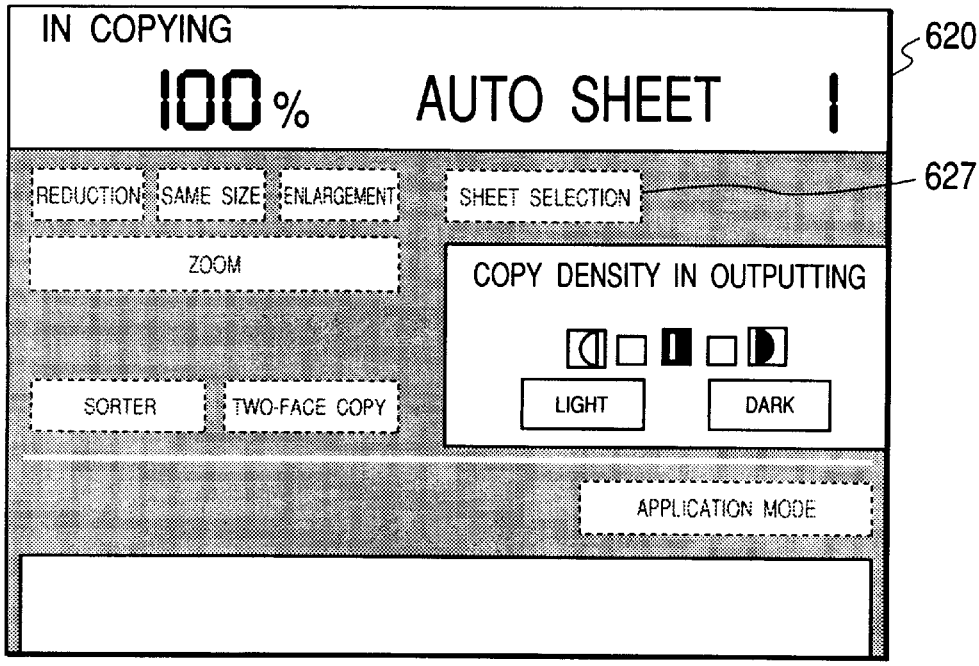

The details of sheet feed setting screens will be described with reference to FIGS. 7A, 7B, 7C and 7D. FIG. 7A shows the screen displayed after the sheet selection key 627 is depressed, and FIG. 7B shows the screen displayed during the job execution. During the job execution, since it is inhibited to change the sheet feed stage by the sheet selection key 627, the key 627 is displayed with shading (or halftone dots) to indicate that the key 627 can not be depressed.

The screen of FIG. 7A indicates that there is no sheet on the manual feed tray 153 and thus a sheet size of the tray 153 is indefinite.

Figure 7C:
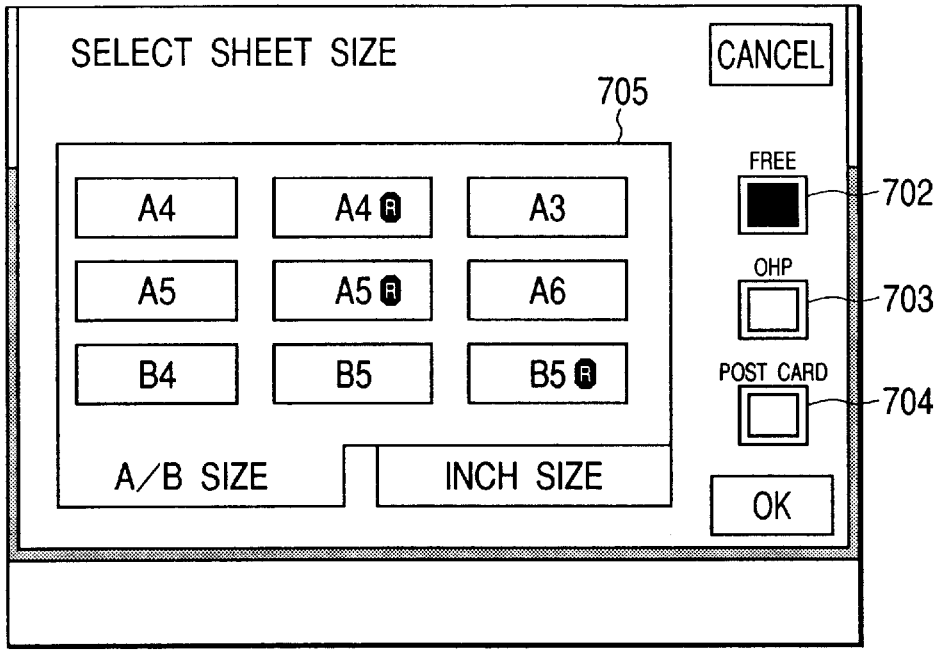

FIG. 7C shows the screen used to set a sheet size and a material for the manual feed tray 153. It is displayed on this screen that the sheet has been set on the tray 153, at timing when a not-shown sheet sensor disposed at an inlet port of the tray 153 detects it. On this screen, the user depresses the key indicating the size of the sheet set on the tray 153. At this time, the user uses a free-size sheet key 702 or a key 705 for various size to set the sheet size. Further, it is possible to set sheet materials such as a post card and an OHP sheet by using keys 703 and 704, respectively.

Figure 7D:
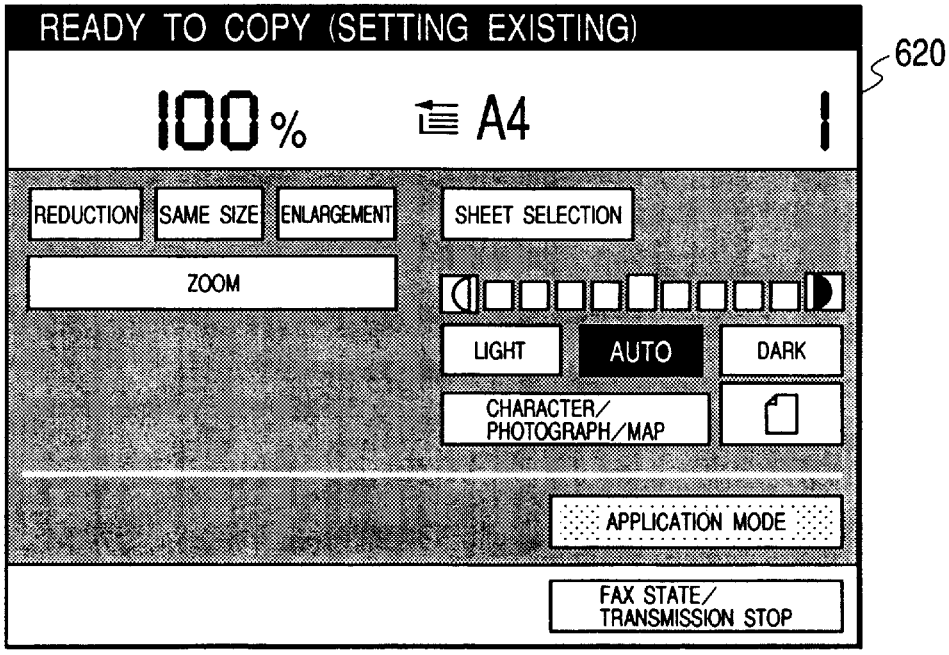

FIG. 7D shows a state that the sheet size is set to "A4" on the manual feed tray setting screen of FIG. 7C and then the screen is closed.

In FIG. 6, numeral 628 to 631 denotes copy magnifying power setting keys, and numeral 626 denotes an application mode setting key. If the key 626 is depressed, a screen for setting application function modes such as a multioperation mode, a reduction layout mode, a cover composition mode and the like is displayed on the panel (not shown), thereby enabling the user to set an application mode. Numeral 624 denotes a two-face operation setting key. For example, the key 624 is used to set three kinds of output modes, i.e., a "one-face original two-face output" mode to perform a two-face output from one-face originals, a "two-face original - two-face output" mode to perform a two-face output from a two-face original, and a "twoface original - one-face output" mode to perform two one-face outputs from a two-face original. Numeral 625 denotes a sort key which is used to set an operation mode of the finisher 190, and set an output sheet sorting mode using the image memory.

If the key which is displayed on the display panel can not be used, it is displayed with shading (or halftone dots). Thus the user can easily recognize that he can not use such the key. In FIG. 6, the contents of the set copying operation and the current operation state are displayed at the upper portion of the display screen 620. Further, it is displayed at the upper left portion of the screen 620 which of the later-described function the current display screen corresponds to. In FIG. 6, the setting screen of copy A is displayed. Although such an indication is displayed by characters in FIG. 6, any icon or sign defining such the indication can be used. Further, on the display screen 620, the operation state of the later-described other function mode is displayed within the range capable of being represented by one line of the lower portion. In FIG. 6, it is displayed that a copy B is being output to the printer unit.

There are not-shown keys next to the application mode setting key 626 within the panel 620. The contents of these keys can be appropriately changed by the user, and it is possible to register maximumly two keys corresponding to the different functions capable of being set on the setting screen in the application mode. By displaying such the application mode setting keys as above, it is possible for the user to set the registered mode more easily.

In FIG. 6, numerals 601 to 612 denote keys and LED display which are used change the displayed contents of the operation unit so as to set various functions concerning copying and system operations of the image formation apparatus 100. Concretely, numerals 601, 604, 607 and 610 denote the keys which are used to change the various functions. These keys are semitransparent keybuttons which contain not-shown display lamps such as LED's respectively. If the function is selected by depressing the key, the lamp within the depressed key is lit. Namely, only the lamp within the key corresponding to the currently selected function is controlled to light, and the lamps within the other function keys are controlled not to light.

The green LED's 603, 606, 609 and 612 are disposed respectively at the right of the keys 601, 604, 607 and 610. Each LED indicates an operation condition of each function by lighting itself. For example, the LED 606 for a copy B function is controlled not to light when the copy B function is on standby, and controlled to blink or flash while the copy B function performs the output operation as shown in FIG. 6. Further, the LED 606 is controlled to light when an image of the copy B function has been stored in the HD 304 of the image memory unit and the printing operation for the copy B function is not performed yet. Similarly, for example, the LED 609 for a facsimile function is controlled to blink during a communication operation, the printing operation and a reading operation, and controlled to light when a facsimile image has been stored in the HD 402 of the facsimile unit.

The red LED's 602, 605, 608 and 611 are arranged respectively at the left of the keys 601, 604, 607 and 610. Each LED indicates that an abnormal condition occurs in each function, by lighting the LED itself. For example, the LED 605 for the copy B function is controlled to blink when abnormality such as interruption due to no sheet, sheet jam or the like occurs in execution of the copy B function. At this time, if the user depresses the copy B function key 604 to change the displayed contents on the operation unit to the copy B display, the condition of the copy B function is displayed on the display panel, whereby he can confirm or know the details of the abnormal condition. Irrespective of the operation condition of each function, the function change keys can be depressed at any time to change the function of the operation unit. As in the present embodiment, if the copy A function and the copy B function can be changed to each other, the keys (i.e., stop key, start key, reset key, etc.) other than the keys within the display panel are operative to the functions selected by the function change keys 601 and 604. For example, during the output operation of the copy B function, while the copy A function operation screen is being displayed, even if the stop key is depressed, it is impossible to stop the copying operation of the copy B function. Namely, if the stop key is depressed after the copy B function key is depressed, it is possible to stop the copying operation of the copy B function. The data set by the user setting key 618 is effective on both the copy A function screen and the copy B function screen. Namely, the user can independently perform the setting in each screen by using the user setting key 618.

Figure 8:
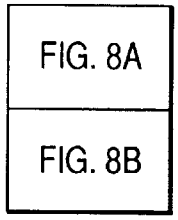
FIG. 8 which is composed of FIGS. 8A and 8B are flow charts showing a setting process of manual sheet feeding.
Figure 8A:
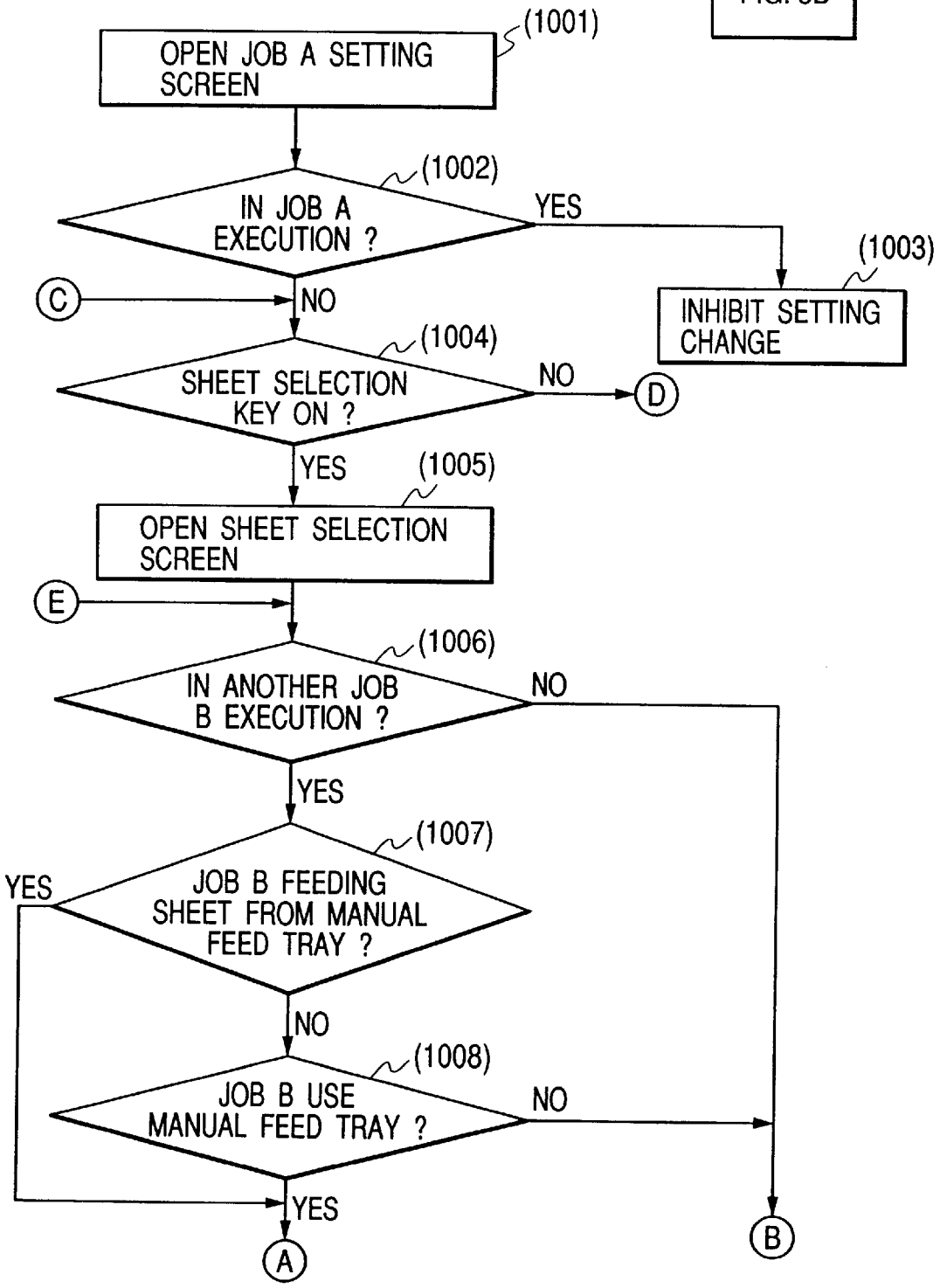
Figure 8B:
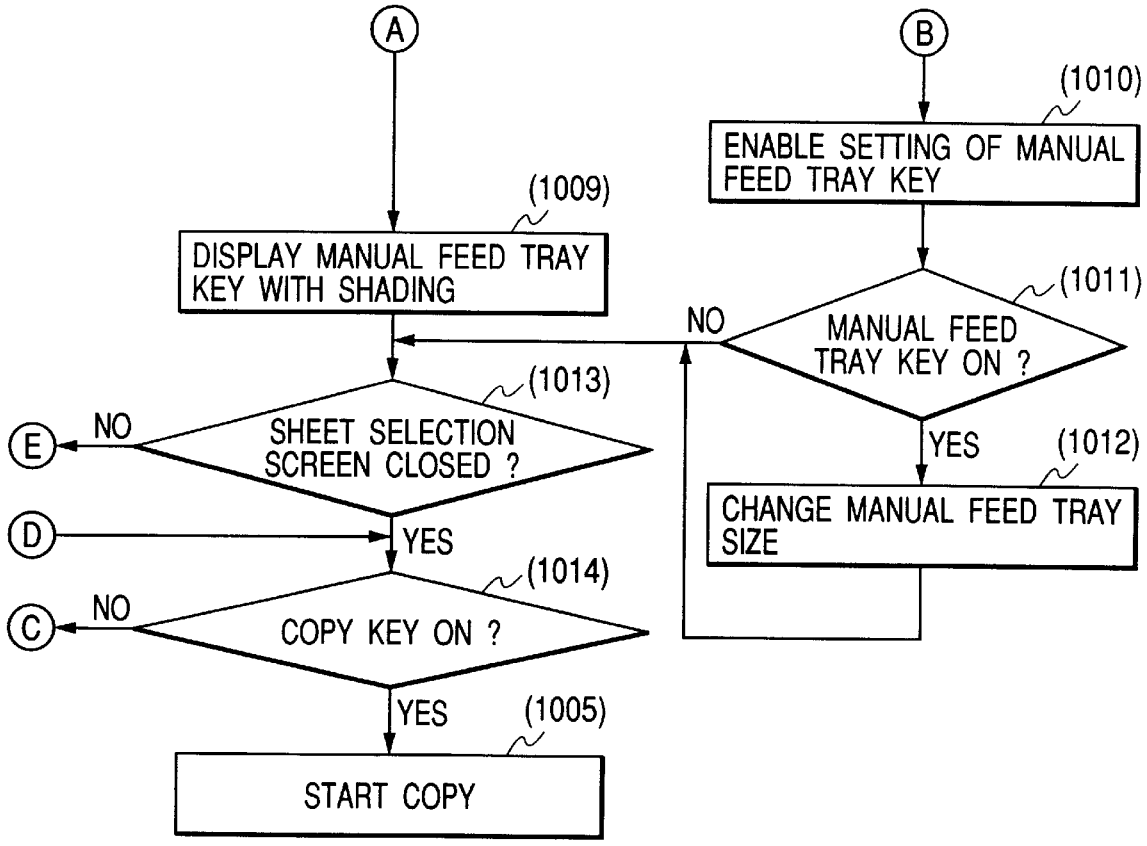

FIGS. 8A and 8B are flow charts showing sheet feed control according to the embodiment of the present invention.

In this flow chart, the process starts from a step 1001 in which the content of the display panel 620 is changed to a print job setting screen (referred as a job A setting screen hereinafter) by the various function change keys 601 to 604.

In a step 1002, it is judged whether or not the job A is being executed. If judged in the step 1002 that the job A is being executed, each key is displayed with shading as shown in FIG. 7B to inhibit the setting change in a step 1003. Conversely, if judged in the step 1002 that the job A is not executed, the flow advances to a step 1004 and subsequent steps. Concretely, it is judged in the step 1004 whether or not the sheet selection key 627 is depressed. If judged that the key 627 is not depressed, the flow advances to a step 1014 and subsequent steps Conversely, if judged in the step 1004 that the key 627 is depressed, the sheet selection screen shown in FIG. 7A is displayed on the display panel 620 in a step 1005.

Figure 9A:
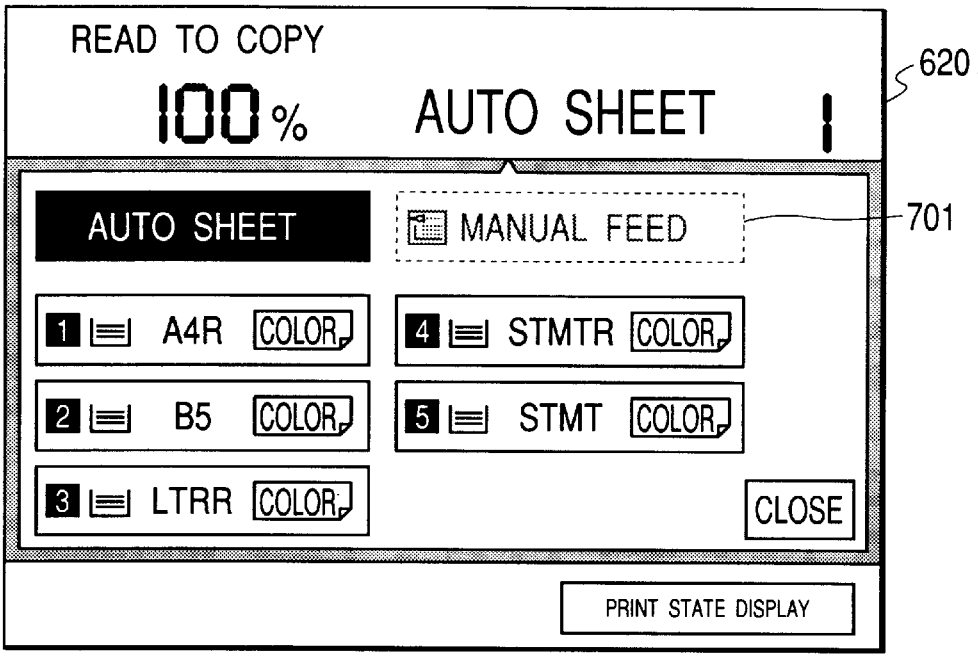
FIGS. 9A and 9B are views showing sheet selection screens.

Then it is judged in a step 1006 whether or not the job B different from the job A corresponding to the setting screen currently displayed on the display panel 620 is being executed. If judged that the job B is not executed, the flow advances to a step 1010 and subsequent steps. conversely, if judged in the step 1006 that the job B is being executed, then it is judged in a step 1007 whether or not in the job B the sheet is fed from the manual feed tray 153. If judged that the sheet is fed from the tray 153 in the job B, the flow advances to a step 1009. Conversely, if judged in the step 1007 that the sheet is not fed from the tray 153 in the job B, then it is judged in a step 1008 whether or not the job B is the job in which the manual feed tray 153 is used. For example, a case where the sheet for the cover is set on the tray 153 in the cover mode corresponds to such the job. If judged in the step 1008 that the job B is the job using the tray 153, then in the step 1009 a manual feed tray key 701 within the sheet selection screen is displayed with shading as shown in FIG. 9A to inhibit the setting change. It should be noted that another sheet feed unit (or stage) is selectable even in this case.

Conversely, if judged in the step 1008 that the job B is not the job using the tray 153, since all the sheet feed units are selectable, the manual feed tray key 701 is not displayed with shading in the step 1010, whereby the user can select the key 701 to change the setting. If the key 701 is selectable in the step 1010, then it is judged in a step 1011 whether or not the key 701 is depressed. If judged in the step 1011 that the key 701 is depressed, the screen shown in FIG. 7C is displayed in a step 1012, whereby the size of the sheet put on the manual feed tray 153 is set to the size instructed by the user. Conversely, if judged in the step 1011 that the key 701 is not depressed, the flow advances to a step 1013. Then in the step 1013, it is judged whether or not the sheet selection screen is closed. Namely, it is judged whether or not a "close" key 706 shown in FIG. 7A is depressed. If judged in the step 1013 that the sheet selection screen is closed, the flow advances to the step 1014. Conversely, if judged in the step 1013 that the screen is not closed, the flow returns to the step 1006. In the step 1014, it is judged whether or not the copy key 614 is depressed. If judged that the copy key 614 is depressed, then the flow advances to a step 1005 to trigger or start the copying operation, whereby the image formation process in the set print mode is performed. Conversely, if judged in the step 1014 that the copy key 614 is not depressed, the flow returns to the step 1004. Even in a case where, in the job B, it is set from the operation unit the cover mode that the original corresponding to the cover in the sheaf of sheets is copied onto the recording sheet different from the recording sheets used for the copying of the other originals, and in a case where the sheet feed stage of the recording sheet to be used to copy the cover is set as the manual feed unit, the manual feed tray key 701 is displayed with shading on the job A setting screen to inhibit the sheet size change.

Further, in a case where the size of the sheet held in the selected sheet feed unit is the same as the set size of the sheet on the manual feed unit, even if an automatic sheet feed change mode is set in the job B to continuously feed the sheet from the manual feed unit when the currently used sheet feed unit becomes empty, the manual feed tray key is displayed with shading in the job A to inhibit the sheet size change.

Figure 9B:
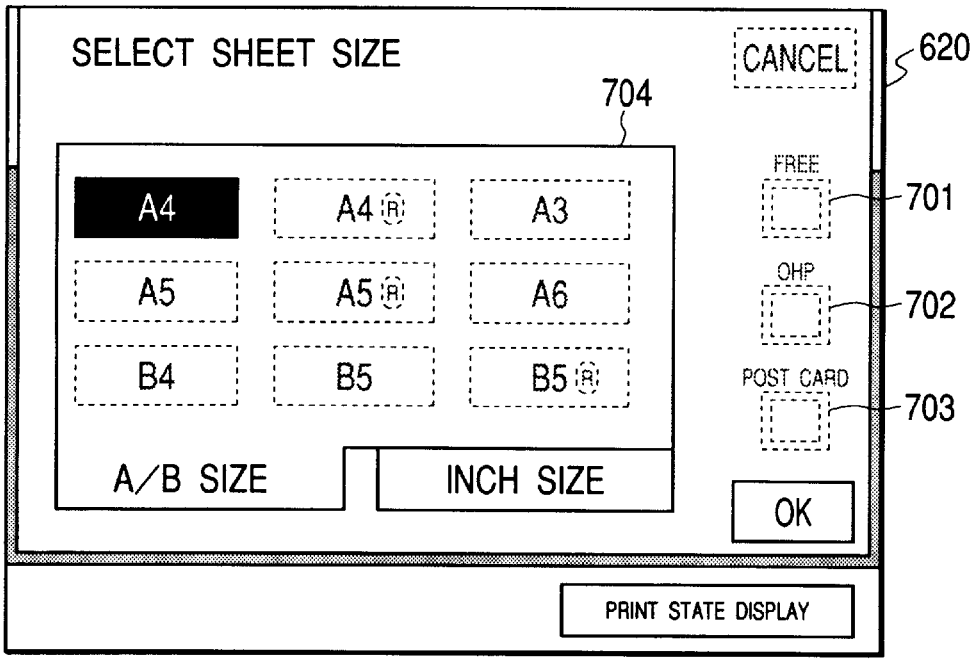

In the embodiment, if the job B is the job in which the manual feed tray is used, the manual feed tray is set to be nonselectable in the job A. However, it is possible to set the manual feed tray to be selectable when the sheet of which size and kind are the same as those of the sheet held in the manual feed tray in the job B is used in the job A. In this case, as shown in FIG. 9B, the size keys corresponding to the sizes other than the size currently selected are displayed with shading on the manual feed tray size selection screen, for size changing. Further, the sheet on the manual feed tray is neither an OHP sheet nor a post card, the OHP key and the post card key are displayed with shading.

Next, an OHP insertion mode will be explained.

Figure 10A:
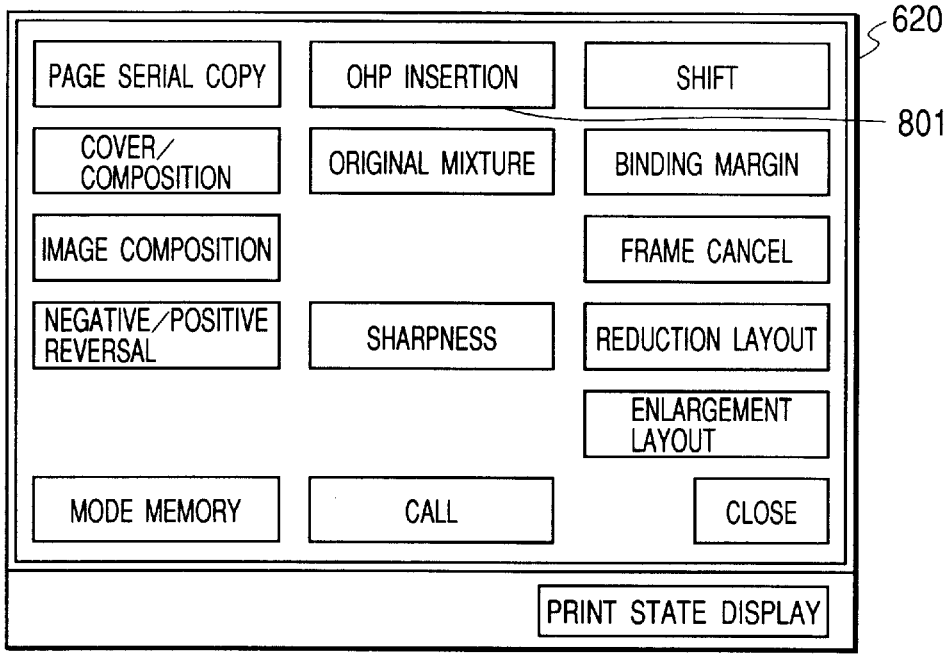
FIGS. 10A and 10B are views showing application mode screens.

If the application mode key 626 shown in FIG. 6 is depressed, since a setting screen for various application function keys shown in FIG. 10A is displayed, the user can set the OHP insertion mode on this screen.

Figures 11, 11A:
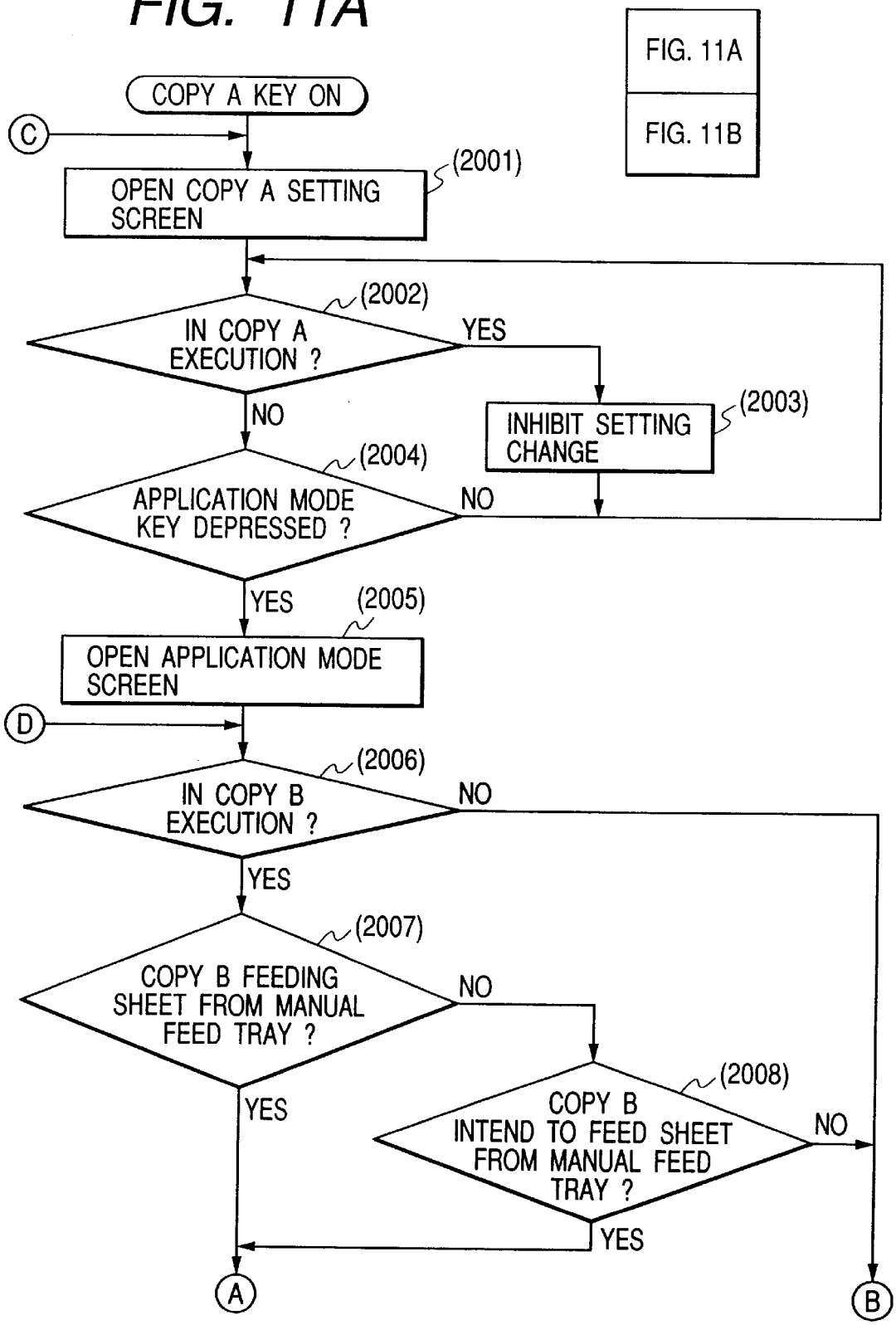
FIG. 11 which is composed of FIGS. 11A and 11B are flow charts showing a setting process of an OHP insertion mode.
Figure 11B:
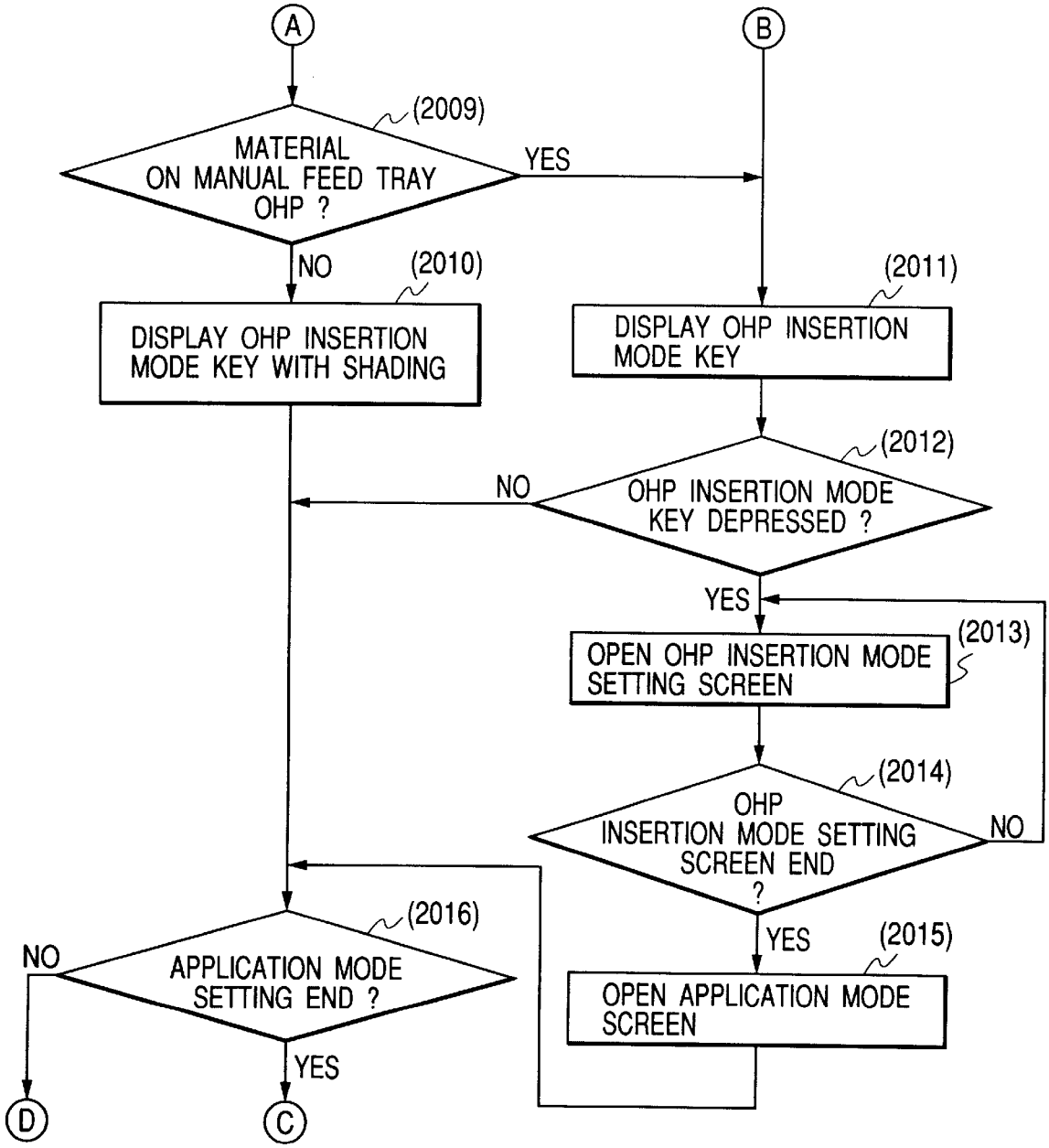

FIGS. 11A and 11B are flow charts showing a setting process of the OHP insertion mode to be performed when the copy A function key 601 is depressed. It should be noted that, in any step of this flow chart, if another function key is depressed, the operation screen corresponding to the depressed key is displayed. First, the copy A setting screen is opened in a step 2001, and it is judged in a step 2002 whether or not the copy A is being executed. If judged in the step 2002 that the copy A is being executed, each key is displayed with shading as shown in FIG. 7B to inhibit the setting change in a step 2003, and the flow returns to the step 2002.

Conversely, if judged in the step 2002 that the copy A is not executed, the flow advances to a step 2004 and subsequent steps. Concretely, it is judged in the step 2004 whether or not the application mode key 626 is depressed. If judged that the key 626 is not depressed, the flow returns to the step 2002.

Conversely, if judged in the step 1004 that the key 626 is depressed, the application mode screen shown in FIG. 10A is displayed on the display panel 620 in a step 2005.

Then it is judged in a step 2006 whether or not the copy B different from the copy A corresponding to the setting screen currently displayed on the display panel 620 is being executed. If judged that the copy B is not executed, the flow advances to a step 2011 and subsequent steps. Conversely, if judged in the step 2006 that the copy B is being executed, then it is judged in a step 2007 whether or not in the copy B the sheet is being fed from the manual feed tray 153.

If judged in the step 2007 that the sheet is fed from the tray 153 in the copy B, the flow advances to a step 2009. Conversely, if judged in the step 2007 that the sheet is not fed from the tray 153 in the copy B, then it is judged in a step 2008 whether or not the copy B is the job in which the manual feed tray 153 is used. For example, the case where the sheet for the cover is set on the tray 153 in the cover mode corresponds to such the job.

If judged in the step 2008 that the copy B is not the job using the tray 153, the flow advances to the later-described step 2011. Conversely, if judged in the step 2008 that the copy B is the job using the tray 153, then it is judged in the step 2009 whether or not the material on the tray 153 is set to be the OHP sheet in the copy B.

Figure 10B:
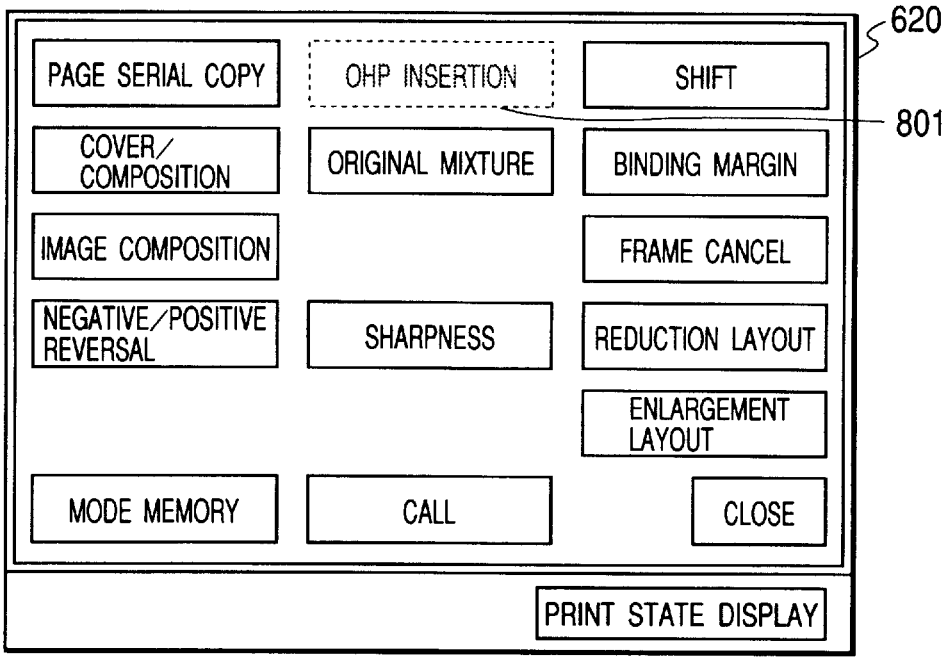

If judged in the step 2009 that the material set on the tray 153 is not the OHP sheet, then in a step 2010 an OHP insertion key 801 is displayed with shading on the application mode screen to represent inhibition of the OHP insertion mode setting as shown in FIG. 10B. Then the flow advances to a step 2016.

Conversely, if judged in the step 2009 that the material on the tray 153 is the OHP sheet, then in the step 2011 the OHP insertion key 801 is displayed without shading on the application mode screen to represent that the OHP insertion mode setting is possible as shown in FIG. 10A. If the OHP insertion mode setting is possible in the step 2011, then it is judged in a step 2012 whether or not the OHP insertion key 801 is depressed.

If judged in the step 2012 that the key 801 is not depressed, the flow advances to the step 2016. Conversely, if judged that the key 801 is depressed, the flow advances to a step 2013 to open the OHP insertion mode setting screen (of which details are omitted). Then, it is judged in a step 2014 whether or not the OHP insertion mode setting ends. If judged that the OHP insertion mode setting ends, the flow advances to a step 2015 to reopen the application mode setting screen, and the flow further advances to the step 2016.

In the step 2016 it is judged whether or not the application mode setting ends. If judged that the application mode setting does not end, the flow returns to the step 2006. Conversely, if judged that the application mode setting ends, the flow returns to the step 2001. In any step of this flow chart, if another function key is depressed, the operation screen corresponding to the depressed key is displayed.

The above-described flow chart shows the process to be performed when the copy A function key is depressed. However, when the copy B function key is depressed, it is similarly controlled whether or not the OHP insertion mode key 801 is to be set operable in accordance with the setting of the manual feed tray in the copy A.

Further, it is possible to control whether or not the OHP insertion mode key 801 is to be set operable in accordance with the setting of the manual feed tray in the printer function. Namely, the control can be expanded to the relation which exceeds the relation between the copy A function and the copy B function. Concretely, in case of setting one job, if the mode that the sheet other than the OHP sheet is set on the manual feed tray in another job is set, it is possible to inhibit the setting of the OHP insertion mode. On the other hand, if the mode that the OHP sheet is set on the manual feed tray in another job is set, it is possible to perform the setting of the OHP insertion mode.

As described above, it is possible to share the manual feed tray on which various materials can be set, with the plural jobs. Further, it is possible to prevent that the sheet outside a schedule is fed from the manual feed tray.

The control substantially the same as that for the manual feed tray can be performed to a cassette to which the material to be held has been designated.

It is needless to say that the object of the present invention can be achieved in a case where a storage medium storing the program codes of a software for realizing the function of the above-described embodiment is supplied to a system or an apparatus and then a computer (or CPU or MPU) in the system or the apparatus reads and executes the program codes stored in the memory medium.

In this case, the program codes themselves read from the storage medium realize the function of the embodiment, and the storage medium storing such the program codes constitute the present invention.

The storage medium storing the program codes can be, for example, a floppy disk, a hard disk, an optical disk, a magnetooptical disk, a CD-ROM, a CD-R, a magnetic tape, a non-volatile memory card, a ROM, an EEPROM, or the like.

It is needless to say that the present invention also includes not only the case where the function of the embodiment is realized by the execution of the program codes read by the computer, but also a case where an OS (operating system) or the like functioning on the computer executes all the process or a part thereof according to the instructions of the program codes, thereby realizing the function of the embodiment.

Further, it is needless to say that the present invention further includes a case where the program codes read from the storage medium are once stored in a memory provided in a function expansion board inserted in the computer or a function expansion unit connected to the computer, and a CPU or the like provided in the function expansion board or the function expansion unit executes all the process or a part thereof according to the instructions of such program codes, thereby realizing the functions of the embodiments. Further, the present invention is applicable to a system composed of plural equipments or to an apparatus including a single equipment. Further, it is needless to say that the present invention is applicable to a case where a program is supplied to a system or an apparatus to realize the function of the embodiment. In this case, if a storage medium storing the program represented by software for realizing the present invention is read by the system or the apparatus, such the system or the apparatus can derive the effect of the present invention.

Further, if the program represented by software for realizing the present invention is downloaded and read from a database on a network by a communication program, such the system or the apparatus can derive the effect of the present invention.

What is claimed is:

1. An image formation apparatus which can perform setting for a second job while a first job is being executed, comprising:

plural holding means including first holding means capable of holding an arbitrary-size recording sheet;

size setting means for manually setting the size of the recording sheet held in said first holding means;

selection means for selecting one of said plural holding means; and control means for inhibiting use of said first holding means in the second job, in a case where the first job is the job which uses said first holding means.

2. An apparatus according to claim 1, wherein, if the first job is the job which does not use said first holding means, said control means allows said selection means to select said first holding means and said size setting means to set the size.

3. An apparatus according to claim 1, wherein the job which uses said first holding means is the job which includes a cover mode that an original for a cover is copied onto a specific recording sheet held in said first holding means.

4. An apparatus according to claim 1, wherein the job which uses said first holding means is the job which includes an automatic sheet feed change mode that, if a recording sheet in the in-feeding holding means is exhausted, sheet feeding from another holding means holding therein a same-size recording sheet is continued.

5. An apparatus according to claim 1, wherein said first holding means is a manual sheet feed unit.

6. An apparatus according to claim 1, wherein said selection means includes a key for selecting each holding means displayed on a touch panel display, and said control means sets the key for selecting said first holding means to be inoperative.

7. An image formation apparatus which can perform setting for a second job while a first job is being executed, comprising:

plural holding means including first holding means capable of holding an arbitrary-size recording sheet;

size setting means for manually setting the size of the recording sheet held in said first holding means;

selection means for selecting one of said plural holding means; and control means for inhibiting size change of the recording sheet of said first holding means in the second job, in a case where the first job is the job which uses said first holding means.

8. An apparatus according to claim 7, wherein, if said size setting means does not perform the size change, said control means allows said selection means to select said first holding means in the second job.

9. An apparatus according to claim 7, wherein the job which uses said first holding means is the job which includes a cover mode that an original for a cover is copied onto a specific recording sheet held in said first holding means.

10. An apparatus according to claim 7, wherein the job which uses said first holding means is the job which includes an automatic sheet feed change mode that, if a recording sheet in the in-feeding holding means is exhausted, sheet feeding from another holding means holding therein a same-size recording sheet is continued.

11. An apparatus according to claim 7, wherein said first holding means is a manual sheet feed unit.

12. An apparatus according to claim 7, wherein said size setting means includes a key for setting each size displayed on a touch panel display, and said control means sets a key for setting the size other than the size of the recording sheet currently held in said first holding means to be inoperative.

13. An image formation apparatus which can perform setting for a second job while a first job is being executed, comprising:

mode setting means for setting various image formation modes;

plural holding means including first holding means capable of holding an arbitrary-size recording sheet;

material setting means for manually setting a material of the recording sheet held in said first holding means;

selection means for selecting one of said plural holding means; and control means for inhibiting, in a case where the first job is the setting that the sheet of a material other than a specific material is held in said first holding means, said mode setting means from setting in the second job the image formation mode which uses the sheet of the specific material.

14. An apparatus according to claim 13, wherein, if the first job is the setting that the sheet of the specific material is held in said first holding means, said control means allows said mode setting means to set in the second job the mode which uses the sheet of the specific material.

15. An apparatus according to claim 13, wherein said first holding means is a manual sheet feed unit.

16. An apparatus according to claim 13, wherein the sheet of the specific material is an OHP (overhead projector) sheet.

17. An apparatus according to claim 13, wherein said mode setting means includes a key for setting various image formation mode displayed on a touch panel display, and said control means sets the key for setting the image formation mode using the sheet of the specific material to be inoperative.

18. A control method for an image formation apparatus which comprises plural holding means including first holding means capable of holding an arbitrary-size recording sheet, size setting means for manually setting the size of the recording sheet held in the first holding means, and selection means for selecting one of the plural holding means, and can perform setting for a second job while a first job is being executed, said method comprising the steps of:

causing the apparatus to execute the first job;

setting an image formation mode in the second job; and inhibiting use of the first holding means in the second job, in a case where the first job is the job which uses the first holding means.

19. A method according to claim 18, further comprising the step of allowing, if the first job is the job which does not use the first holding means, the selection means to select the first holding means and the size setting means to set the size.

20. A method according to claim 18, wherein the job which uses the first holding means is the job which includes a cover mode that an original for a cover is copied onto a specific recording sheet held in the first holding means.

21. A method according to claim 18, wherein the job which uses the first holding means is the job which includes an automatic sheet feed change mode that, if a recording sheet in the in-feeding holding means is exhausted, sheet feeding from another holding means holding therein a same-size recording sheet is continued.

22. A method according to claim 18, wherein the first holding means is a manual sheet feed unit.

23. A method according to claim 18, wherein the selection means includes a key for selecting each holding means displayed on a touch panel display, and in said inhibition step the key for selecting the first holding means is set to be inoperative.

24. A control method for an image formation apparatus which comprises plural holding means including first holding means capable of holding an arbitrary-size recording sheet, size setting means for manually setting the size of the recording sheet held in the first holding means, and selection means for selecting one of the plural holding means, and can perform setting for a second job while a first job is being executed, said method comprising the steps of:

causing the apparatus to execute the first job;

setting an image formation mode in the second job; and inhibiting the size setting means from performing size change of the recording sheet of the first holding means in the second job, in a case where the first job is the job which uses the first holding means.

25. A method according to claim 24, further comprising the step of allowing, if the size setting means does not perform the size change, the selection means to select the first holding means in the second job.

26. A method according to claim 24, wherein the job which uses the first holding means is the job which includes a cover mode that an original for a cover is copied onto a specific recording sheet held in the first holding means.

27. A method according to claim 24, wherein the job which uses the first holding means is the job which includes an automatic sheet feed change mode that, if a recording sheet in the in-feeding holding means is exhausted, sheet feeding from another holding means holding therein a same-size recording sheet is continued.

28. A method according to claim 24, wherein the first holding means is a manual sheet feed unit.

29. A method according to claim 24, wherein the size setting means includes a key for setting each size displayed on a touch panel display, and in said inhibition step a key for setting the size other than the size of the recording sheet currently held in the first holding means is set to be inoperative.

30. A control method for an image formation apparatus which comprises mode setting means for setting various image formation modes, plural holding means including first holding means capable of holding an arbitrary-size recording sheet, material setting means for manually setting a material of the recording sheet held in the first holding means, and selection means for selecting one of the plural holding means, and can perform setting for a second job while a first job is being executed, said method comprising the steps of:

causing the apparatus to execute the first job;

setting an image formation mode in the second job; and inhibiting, in a case where the first job is the setting that the sheet of a material other than a specific material is held in the first holding means, the mode setting means from setting in the second job the image formation mode which uses the sheet of the specific material.

31. A method according to claim 30, further comprising the step of allowing, if the first job is the setting that the sheet of the specific material is held in the first holding means, the mode setting means to set in the second job the mode which uses the sheet of the specific material.

32. A method according to claim 30, wherein the first holding means is a manual sheet feed unit.

33. A method according to claim 30, wherein the sheet of the specific material is an OHP (overhead projector) sheet.

34. A method according to claim 30, wherein the mode setting means includes a key for setting various image formation mode displayed on a touch panel display, and in said inhibition step the key for setting the image formation mode using the sheet of the specific material is set to be inoperative.

* * * * *

UNITED STATES PATENT AND TRADEMARK OFFICE

CERTIFICATE OF CORRECTION

PATENT NO. : 6,169,863 B1
DATED : January 2, 2001
INVENTOR(S) : Osari et al.

It is certified that error appears in the above-identified patent and that said Letters Patent is hereby corrected as shown below:

Column 1,
Line 28, "as the such" should read -- to which --;
Line 33, "thus being" should read -- is thus --;
Line 45, "the case, following" should read -- a case, the following --; and
Line 54, "of which" should read -- whose --.

Column 3,
Line 64, "carrying" should read -- carry --.

Column 4,
Line 31, "an" should read -- a --.

Column 5,
Line 17, "such" should be deleted.

Column 6,
Line 41, "such" should be deleted.

Column 7,
Line 2, "once" should read -- first --;
Line 4, "of which" should read -- whose --;
Line 35, "greed" should read -- green --; and
Line 42, "such" should be deleted.

Column 8,
Line 20, "size" (first occurrence) should read -- sizes --;
Line 26, "numeral 638 to 631 denotes" should read -- numerals 628 to 631 denote --;
Line 35, "original two-face" should read -- original → two-face --;
Line 37, "nal - two-face" should read -- nal → two-face --;
Line 38, "twoface original - one-face" should read -- two-face original → one-face --;
Line 45, "such" should be deleted;
Line 53, "such" should be deleted; and
Line 65, "such" should be deleted.

Column 9,
Line 2, "used" should read -- used to --; and
Line 63, "(referred" should read -- referred to --.

UNITED STATES PATENT AND TRADEMARK OFFICE

CERTIFICATE OF CORRECTION

PATENT NO. : 6,169,863 B1
DATED : January 2, 2001
INVENTOR(S) : Osari et al.

It is certified that error appears in the above-identified patent and that said Letters Patent is hereby corrected as shown below:

Column 11,
Line 10, "of which" should read -- whose --; and
Line 60, "such the" should read -- such a --.

Column 12,
Line 18, "details" should read -- the details --; and
Line 66, "such" should be deleted.

Column 13,
Line 15, "once" should read -- first --;
Line 21, at "Further," begin a new paragraph --;
Line 24, at "Further," begin a new paragraph --;
Line 29, "such" should be deleted; and
Line 35, "the system or the" should read -- a system or --.

Column 15,
Line 1, "mode" should read -- modes --.

Column 16,
Line 50, "mode" should read -- modes --.

Signed and Sealed this

Fourteenth Day of May, 2002

*Attest:*

*Attesting Officer*

JAMES E. ROGAN
*Director of the United States Patent and Trademark Office*